US007674084B2

(12) United States Patent
Lech

(10) Patent No.: US 7,674,084 B2
(45) Date of Patent: Mar. 9, 2010

(54) HYDRAULICALLY CUSHIONED BACKHOE BOOM BUMPER AND TRAVEL LIMITER

(75) Inventor: Richard J. Lech, Burlington, IA (US)

(73) Assignee: CNH America LLC, New Holland, PA (US)

( * ) Notice: Subject to any disclaimer, the term of this patent is extended or adjusted under 35 U.S.C. 154(b) by 42 days.

(21) Appl. No.: 11/741,805

(22) Filed: Apr. 30, 2007

(65) Prior Publication Data

US 2008/0267755 A1 Oct. 30, 2008

(51) Int. Cl.
*E02F 3/26* (2006.01)

(52) U.S. Cl. ..... 414/694; 91/41; 188/265; 303/89

(58) Field of Classification Search ..... 414/694, 414/799; 188/265; 303/89; 91/41, 42
See application file for complete search history.

(56) References Cited

U.S. PATENT DOCUMENTS 1,766,255 A 6/1930 Mullally
3,559,821 A 2/1971 James
3,661,285 A 5/1972 Appleman
4,154,349 A 5/1979 Christensen
4,184,803 A 1/1980 Housman
4,344,733 A 8/1982 Hirsch
4,370,090 A 1/1983 Shumaker et al.
4,583,906 A 4/1986 Frisbee
4,978,243 A 12/1990 Hensler
5,676,264 A 10/1997 Wilson
5,875,678 A 3/1999 McNamara

*Primary Examiner*—Donald Underwood
(74) *Attorney, Agent, or Firm*—Patrick M. Sheldrake; John William Stader; Michael G. Harms

(57) ABSTRACT

A system is used with a boom pivoted on a frame about a horizontal pivot axis between raised and lowered positions by a first fluid ram joining the frame and the boom. A releasable locking mechanism locks the boom relative to the frame to prevent pivotal movement of the boom about its horizontal pivot axis. A second fluid ram is disposed between the frame and the boom, the second fluid ram compressed between the frame and the boom when the boom is adjacent the raised position, but prior to the boom achieving a latched position substantially coinciding with the raised position. A fluid circuit of the second fluid ram has two selectable pressure levels. The first level substantially prevents the boom from achieving the latched position, the second level permits the boom to achieve the latched position while providing fluid cushioning to dissipate impact forces between the boom and frame.

20 Claims, 8 Drawing Sheets

HYDRAULICALLY CUSHIONED BACKHOE BOOM BUMPER AND TRAVEL LIMITER

FIELD OF THE INVENTION

The present invention relates generally to excavating machines, and, more particularly, to excavating machines having booms pivoted on a frame about a horizontal pivot axis between raised and lowered positions.

BACKGROUND OF THE INVENTION

Excavating machines, such as tractor loader backhoes (TLBs), are versatile in their ability to load material by virtue of implements, such as buckets, disposed at each end of the tractor. The conventional backhoe includes a boom mounted on the rear of a tractor carrying a pivotal bucket for the digging operation. The boom is mounted on a frame about a horizontal pivot axis between raised and lowered positions by a fluid ram joining the frame and the boom. When the backhoe is not in operation, it is typically desirable to bring the boom to a raised position where it engages a latching mechanism and is maintained in the raised latched position. Maintaining the boom in the latched position moves the center of gravity of the backhoe forward, which is desirable for improved operation of the machine.

However, there are problems associated with bringing the boom to the latched position in a smooth fashion. If the operator has not sufficiently slowed the rate at which the boom 14 is being raised as the boom approaches the raised position (FIG. 3) from a lowered position (FIG. 1), upon the boom 14 achieving the raised position, boom 14 will impact frame 20. The magnitude of such impact can be significant, due to the large combined weight of the backhoe 12, especially when the backhoe is traveling at significant speed toward the cab of the machine 10. As shown in FIG. 4, a bumper 44, typically comprised of high density rubber or the like, is the only buffer between contacting surfaces of frame 20 and boom 14. Bumper 44 provides little impact absorption, the resulting impact between the boom 14 and frame 20 subjecting the machine 10 to a sudden and violent jarring effect that can not only damage the machine 10, but similarly subjects the operator to the jarring effect.

Once the boom 14 achieves the raised position, a latching device 76 can be actuated to place the boom in a latched position (see FIGS. 4 and 6). In the latched position, the bumper 44 is compressed between the boom 14 and the frame 20. However, due to the large mass of the backhoe 12, while the machine is driven or is moved between work sites, road imperfections cause the backhoe 12 to "bounce" in the latched position, imparting shock loads into the machine structure. As bumper 44 wears through time and usage, the movement of the backhoe 12 with respect to machine 10 increases, similarly increasing the magnitude of these shock loads and adversely affecting the overall travel or "roading" quality of the machine.

Further, certain backhoe operations, such as when material is to be loaded into a truck and the boom achieves substantially raised positions, it possible for the boom to inadvertently latch with the latching device. Such inadvertent latching requires the operator to unlatch the boom before further work can be performed, which is disruptive and inefficient.

What is needed is a system that helps dissipate the jarring impacts between the boom and the frame, both while achieving a raised position of the boom and while the machine is operating with the backhoe in the latched position, but additionally, substantially preventing inadvertent achievement of the latching position of the boom.

SUMMARY OF THE INVENTION

The present invention relates to a system for use with a boom of an excavating machine. The boom is pivoted on a frame of the machine about a horizontal pivot axis between raised and lowered positions by a first fluid ram joining the frame and the boom. A releasable locking mechanism locks the boom relative to the frame prevents pivotal movement of the boom about its horizontal pivot axis. The system includes a second fluid ram disposed between the frame and the boom, the second fluid ram compressed between the frame and the boom when the boom is adjacent the raised position, but prior to the boom achieving a latched position substantially coinciding with the raised position. A fluid circuit of the second fluid ram has two selectable pressure levels. The first pressure level substantially prevents the boom from achieving the latched position. The second pressure level permits the boom to achieve the latched position while providing fluid cushioning to dissipate impact forces between the boom and the frame.

The present invention further relates to an excavating machine including a backhoe boom, the boom pivoted on a frame about a horizontal pivot axis between raised and lowered positions by a first fluid ram joining the frame and the boom. A releasable locking mechanism locks the boom relative to the frame to prevent pivotal movement of the boom about its horizontal pivot axis. A second fluid ram is disposed between the frame and the boom. The second fluid ram is compressed between the frame and the boom when the boom is adjacent the raised position, but prior to the boom achieving a latched position substantially coinciding with the raised position. A fluid circuit of the second fluid ram has two selectable pressure levels. The first pressure level substantially prevents the boom from achieving a latched position. The second pressure level permits the boom to achieve a latched position while providing fluid cushioning to dissipate impact forces between the boom and the frame.

The present invention yet further relates to a method for dissipating impact forces associated with selectively achieving a latched position of a backhoe boom of an excavating machine. The latched position is suitable for transport of the excavating machine, while selectively avoiding inadvertent achievement of the latched position. The method includes the steps of providing the backhoe boom, the boom pivoted on a frame about a horizontal pivot axis between raised and lowered positions by a first fluid ram joining the frame and the boom. The method further includes providing a releasable locking mechanism for locking the boom relative to the frame to prevent pivotal movement of the boom about its horizontal pivot axis. The method further includes providing a second fluid ram disposed between the frame and the boom. A third fluid ram is compressed between the frame and the boom when the boom is adjacent the raised position, but prior to the boom achieving the latched position substantially coinciding with the raised position. The third fluid ram is in fluid communication with a fluid circuit having two pressure levels. The method further includes selecting a first pressure level configured to permit the boom to achieve the latched position, when achievement of the latched position is desired, while providing fluid cushioning to dissipate impact forces between the boom and the frame. The method further includes selecting a second pressure level configured to substantially prevent the boom from achieving the latched position when inadvertent achievement of the latched position is not desired.

An advantage of the present invention is that the durability of the machine is improved.

A further advantage of the present invention is that the operating environment for the operator is improved, both while achieving a raised position of the boom and while operating the machine with the boom in a latched position.

A still further advantage of the present invention is that the operating efficiency of the machine is improved.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
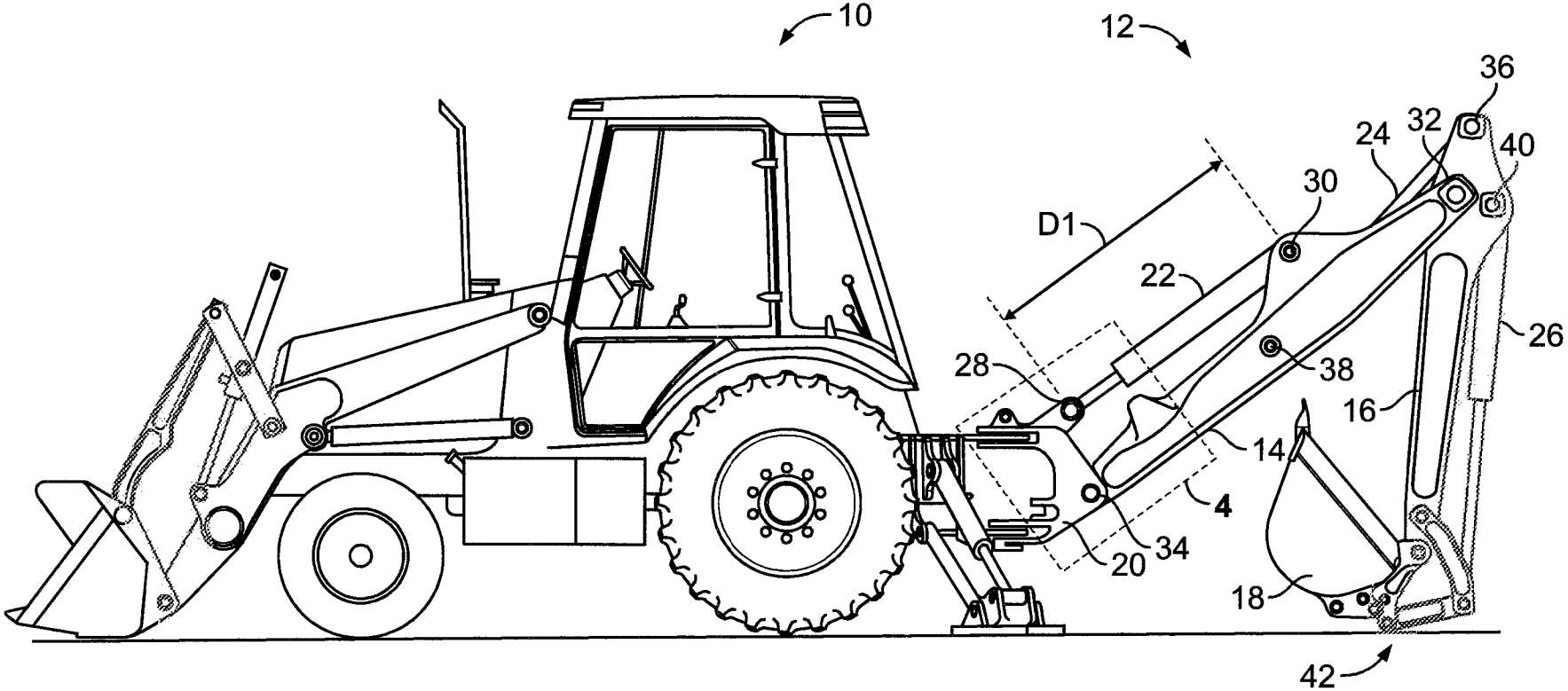
FIG. 1 is a side elevational view of an excavating machine having a boom in a lowered position, the machine employing the present invention.
Figure 2:
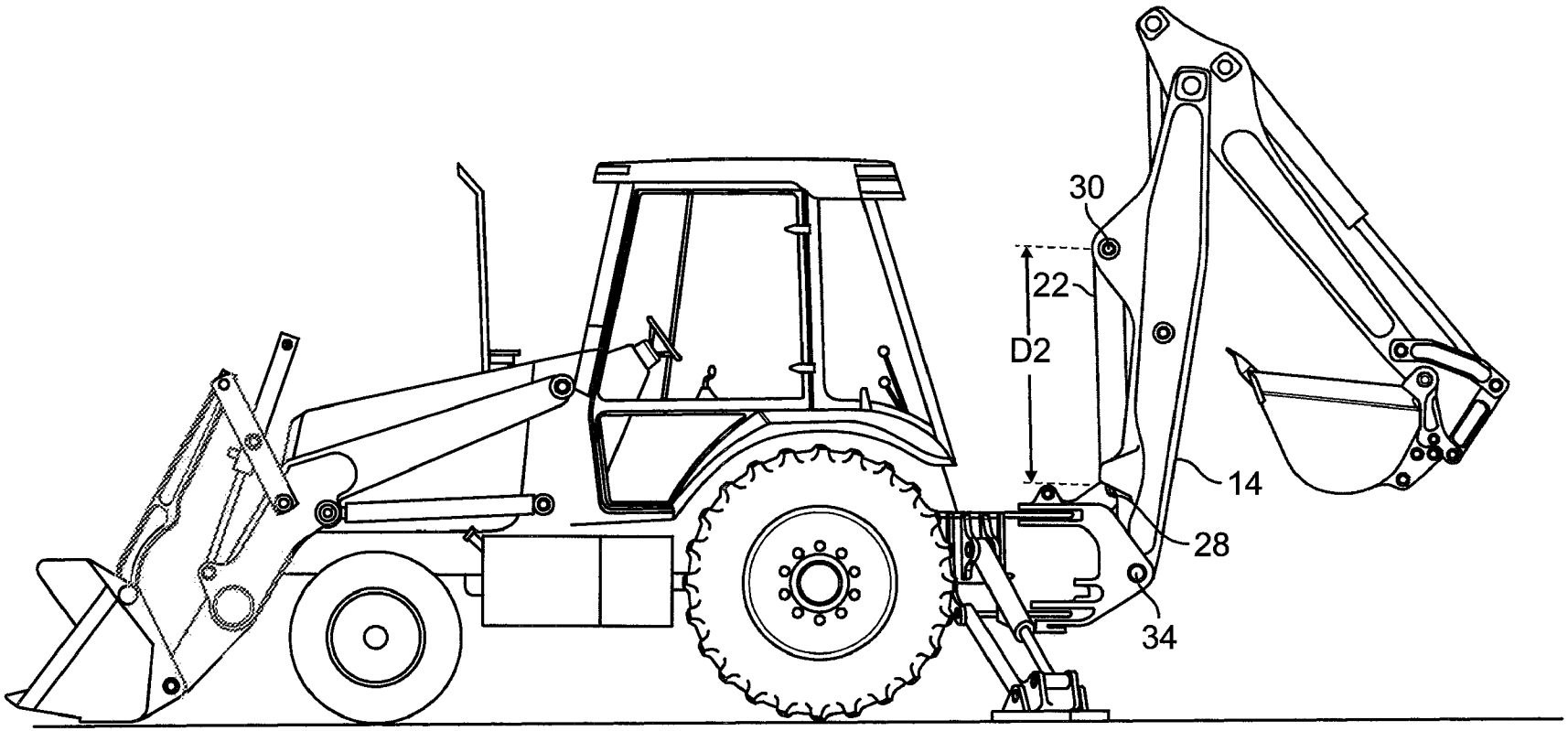
FIG. 2 is similar to FIG. 1 with the boom in a substantially raised position, the machine employing the present invention.
Figure 3:
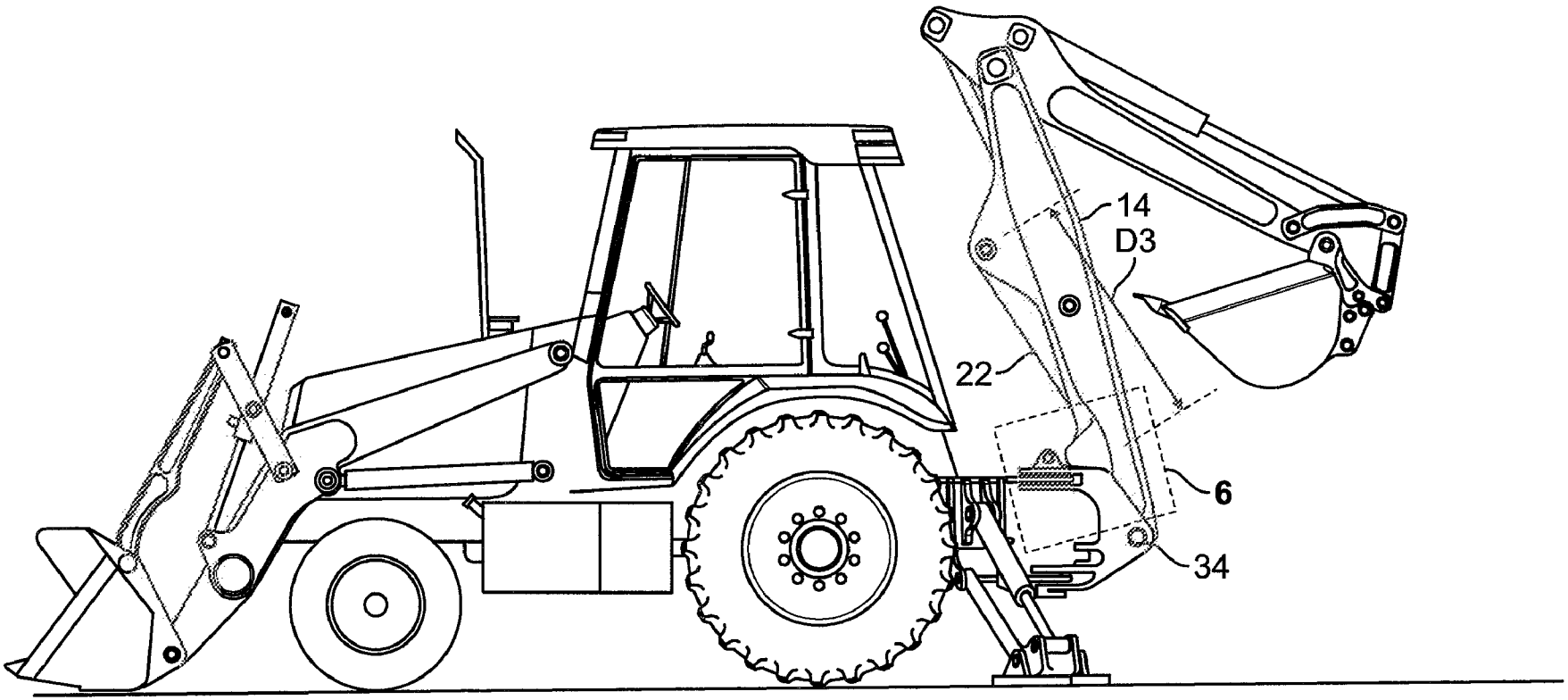
FIG. 3 is similar to FIG. 1 with the boom in a raised position, the machine employing the present invention.

Referring to the drawings for a description of an earthworking machine 10 that employs the present invention, FIGS. 1-3 show boom 14 in a lowered position (FIG. 1), a substantially raised position (FIG. 2) and a fully raised position (FIG. 3). Boom 14 pivots about a pivot joint 34 and coincident pivot axis of a frame 20 and is controlled by extension/contraction of a fluid ram 22 connected between pivot joints 28, 30. Similarly, an arm 16, often referred to as a dipper, pivots about pivot joint 32 of boom 14 and is controlled by extension/contraction of fluid ram 24 connected between pivot joints 36, 38. In addition, implement 18, such as a bucket, is pivotably connected to arm 16 and is controlled by extension/contraction of a fluid ram 26 connected between pivot joint 40 and interconnected linkages 42. A backhoe 12 comprises the combination of boom 14, arm 16, implement 18 and pivoting connections therebetween.

The present invention helps dissipate the jarring impacts between the boom and the frame, both while achieving a raised position of the boom and while the machine is operating with the backhoe in the latched position, but additionally, substantially preventing inadvertent achievement of the latching position of the boom.

To further clarify the problems associated with the operation of boom 14 addressed by the present invention, the geometry of fluid ram 22 is further discussed. FIGS. 1-3 show boom 14 in a lowered position (FIG. 1), a substantially raised position (FIG. 2) and a fully raised position (FIG. 3). Boom 14 pivots about a pivot joint 34 and coincident pivot axis of a frame 20 and is controlled by extension/contraction of a fluid ram 22 connected between pivot joints 28, 30. Fluid ram 22 accordingly has a different length corresponding to each boom 14 position. Fluid ram 22 length D1 in FIG. 1 is longer than D3 (FIG. 3) and D3 is longer than D2 (FIG. 2). Thus represented symbolically, D1>D3>D2. As shown in FIG. 2, ram length D2 is at its most contracted or shortest length. In other words, as boom 14 is brought from a lowered position (FIG. 1) toward the substantially raised position (FIG. 2), the length of fluid ram 22 is continuously shortened. However, once the boom 14 achieves the substantially raised position (FIG. 2) and is further pivoted toward the fully raised position (FIG. 3), fluid ram 22 is lengthened. Stated another way, boom 14 and fluid ram 22 employ an over-center locking arrangement. This means that an operator must possess sufficient coordination and skills to reverse the direction of fluid flow to fluid ram 22 when boom 14 passes the substantially raised position (FIG. 2) toward the fully raised position (FIG. 3) in order for the boom 14 to achieve the fully raised position. Otherwise, fluid ram 22 will typically prevent the boom 14 from achieving the fully raised position. Examples of the over-center locking arrangement have been previously discussed in U.S. Pat. Nos. 5,176,491 and 6,267,548.

Figure 4:
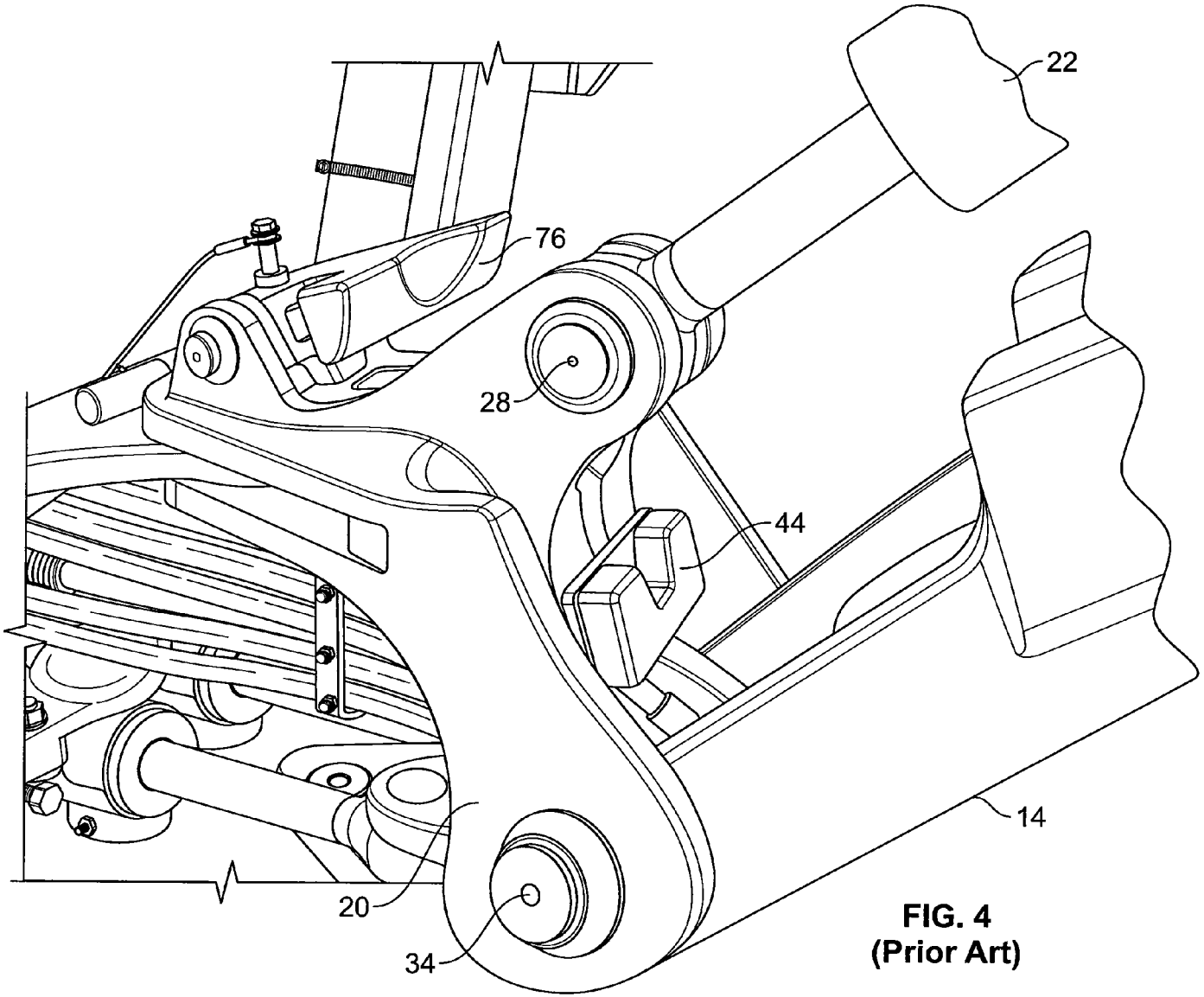
FIG. 4 (Prior Art)
FIG. 4 is an enlarged partial perspective view taken from region 4 of FIG. 1, showing a known art bumper arrangement.

If the rate at which the boom 14 is being raised as the boom approaches the raised position (FIG. 3) from a lowered position (FIG. 1) is not sufficiently slowed, upon the boom 14 achieving the raised position, boom 14 will impact frame 20. The magnitude of such impact can be significant, due to the large combined weight of the backhoe 12, especially when the backhoe is traveling at significant speed toward the cab of the machine 10. As shown in FIG. 4, a bumper 44, typically comprised of high density rubber or the like, is the only buffer between contacting surfaces of frame 20 and boom 14. Bumper 44 provides little impact absorption, the resulting impact between the boom 14 and frame 20 subjecting the machine 10 to a sudden and violent jarring effect that can not only damage the machine 10, but similarly subjects the operator to the jarring effect.

Figure 6:
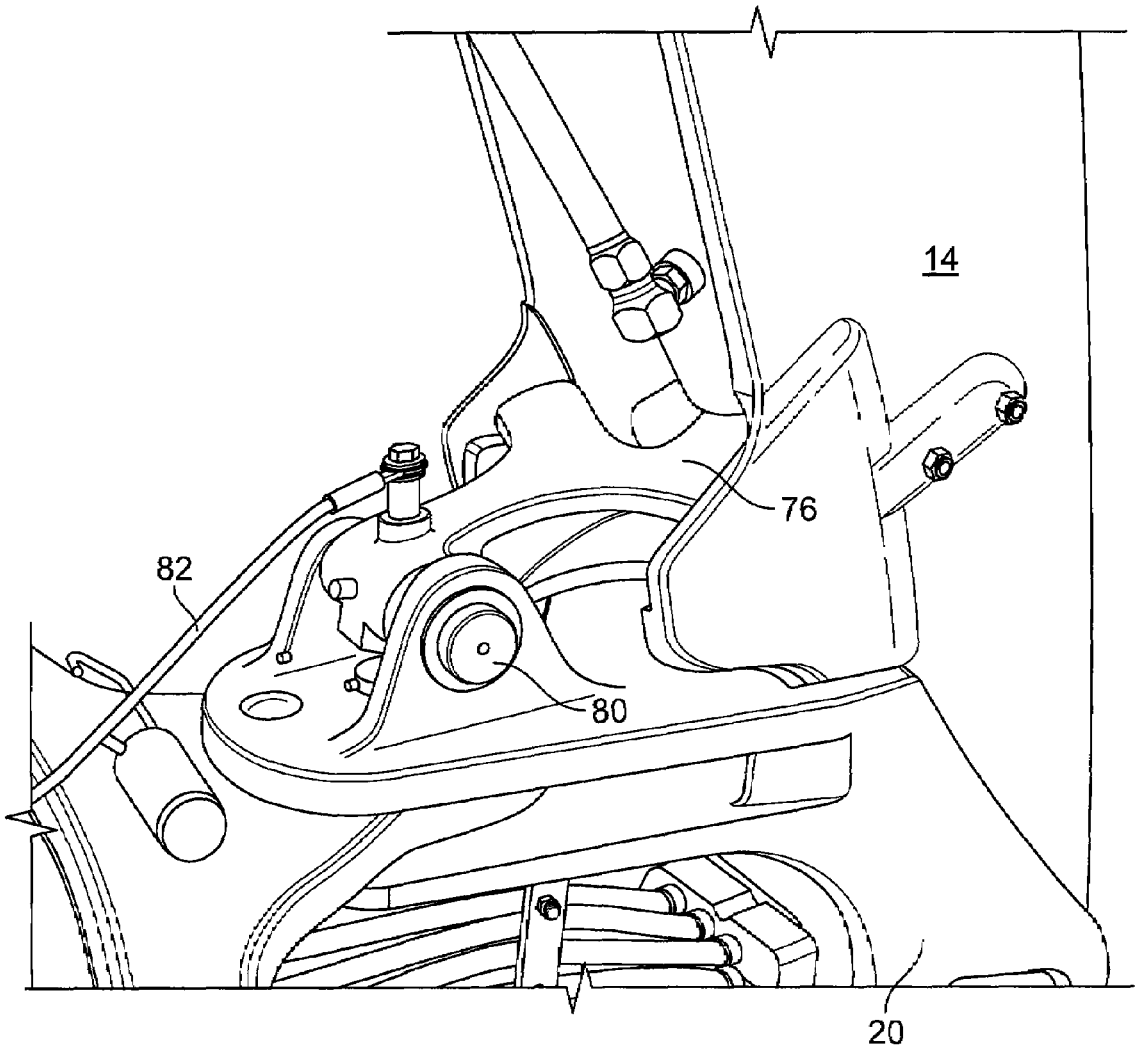
FIGS. 6 and 7 are each enlarged partial perspective views taken from region 6 of FIG. 3, showing engagement and disengagement, respectively, of a latching device used to achieve the latched position of the present invention.

In addition, another problem endured by machine operators is inadvertent latching of the boom 14. Once the boom 14 achieves the raised position (FIG. 4), a latching device 76 can be actuated, such as by pivoting the latching device 76 about pivot joint 80 (FIG. 6) to place the boom in a latched position (see FIGS. 4 and 6). In the latched position, the bumper 44 is compressed between the boom 14 and the frame 20. However, due to the large mass of the backhoe 12, while the machine is driven or is moved between work sites, road imperfections cause the backhoe 12 to "bounce" in the latched position, imparting shock loads into the machine structure. As bumper 44 wears through time and usage, the movement of the backhoe 12 increases, similarly increasing the magnitude of these shock loads and adversely affecting the overall travel or "roading" quality of the machine.

Figure 7:
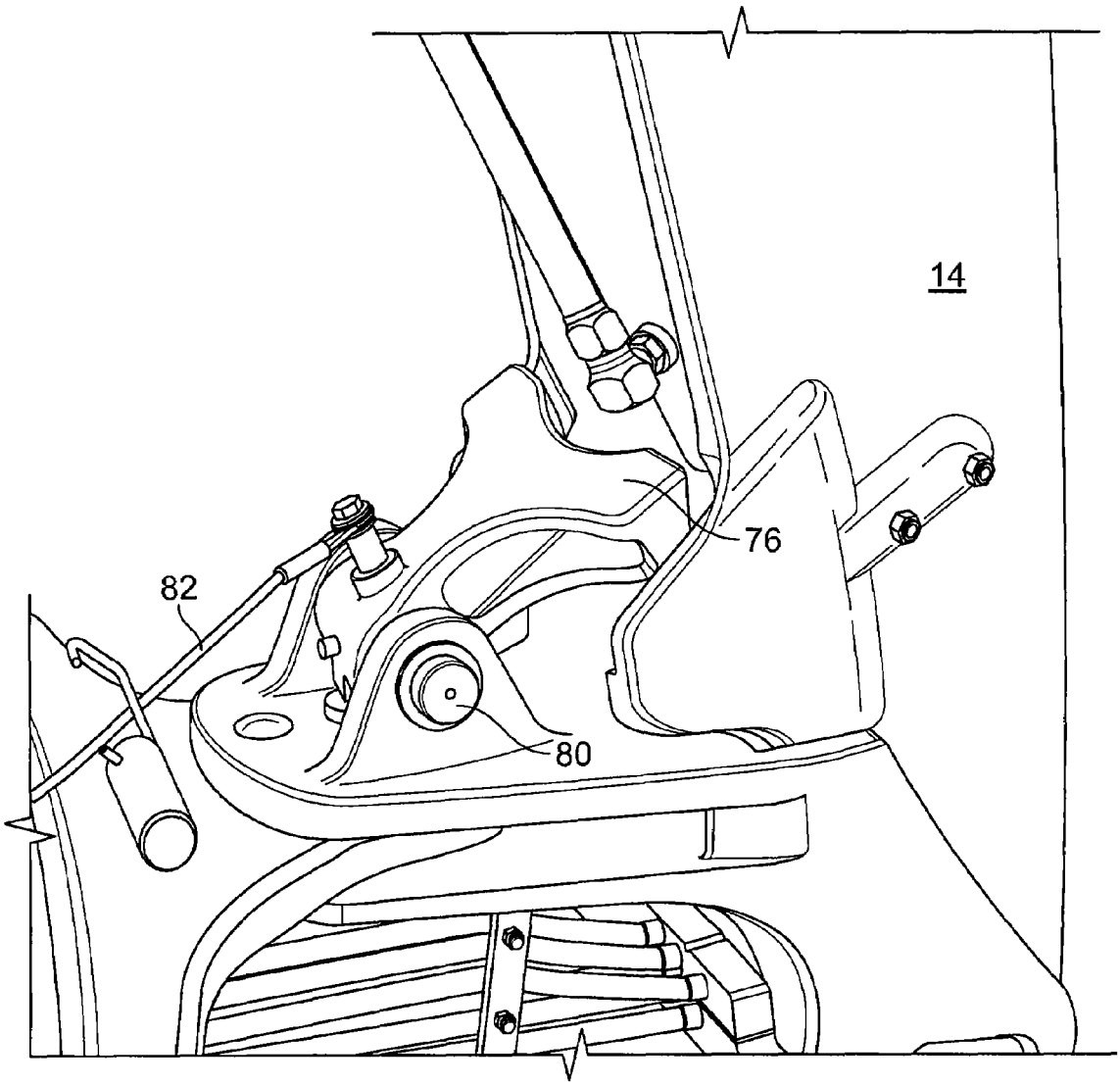

Further, while operating the backhoe, such as when material is to be loaded into a truck and the boom achieves substantially raised positions, it possible for the boom 14 to inadvertently latch with the latching device 76. Such inadvertent latching requires the operator to unlatch the boom 14, such as by actuating a wire 82 to rotate the latching device 76 away from its engaged position with the boom 14 (FIG. 7) before further work can be performed, which is disruptive and inefficient.

Figure 5:
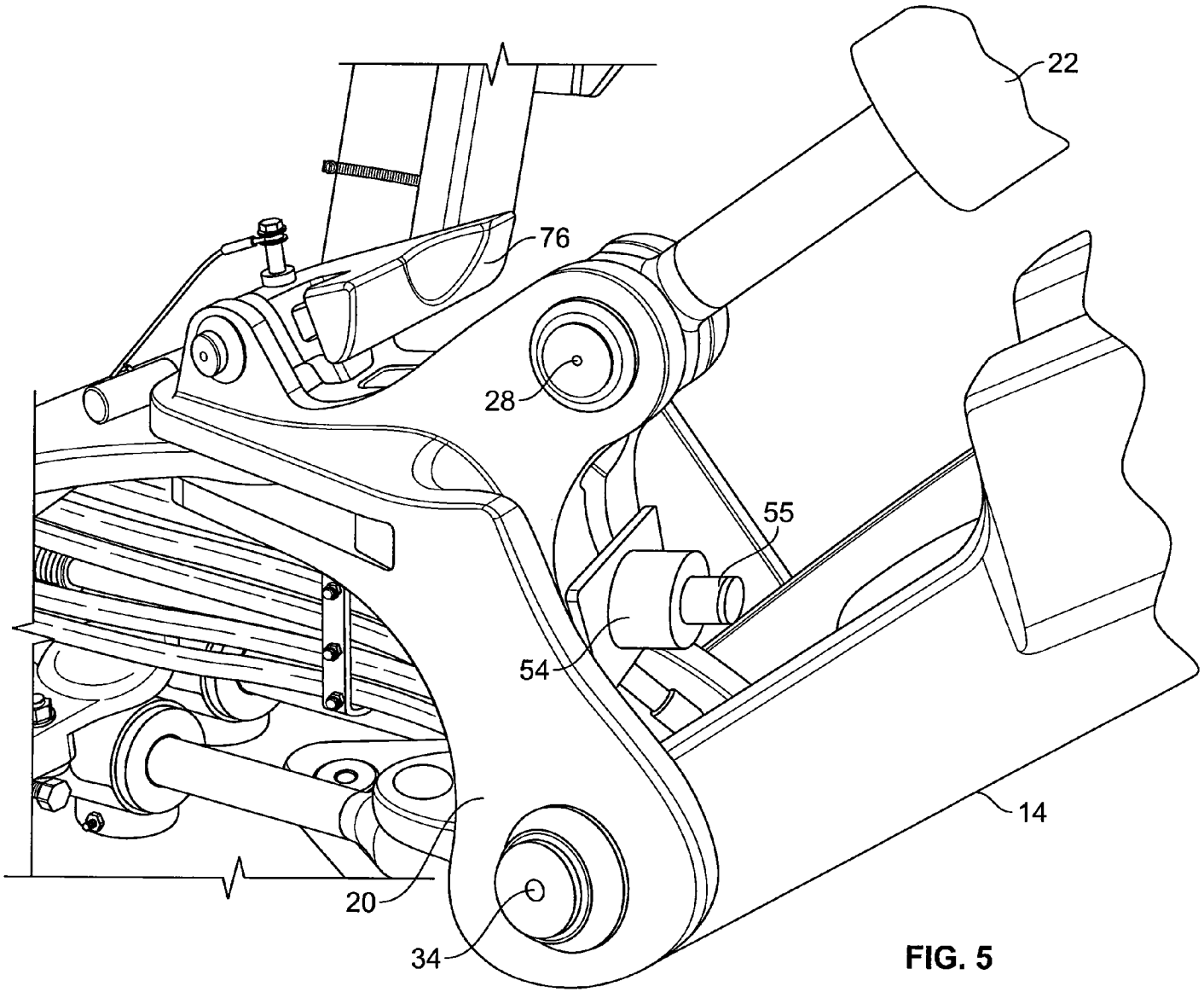
FIG. 5 is an enlarged partial perspective view taken from region 4 of FIG. 1, showing a fluid ram of the present invention.

FIG. 5 shows a fluid ram 54 disposed between frame 20 and boom 14. Upon boom 14 being brought sufficiently adjacent to frame 20, such as approximately when boom 14 achieves the substantially raised position (FIG. 2), but prior to the boom achieving the raised position (FIG. 4), boom 14 and frame 20 begin to apply a compressive force to fluid ram 54. In one embodiment, fluid ram 54 includes a cap 55 constructed of a dense, resilient material, similar to bumper 44, although the resilient material could additionally or alternately be positioned between fluid ram 54 and frame 20. As will be described in additional detail below, fluid ram 54 can be selectively operated between two pressure levels: a first pressure level that is configured to permit the boom 14 to achieve the latched position, when achievement of the latched position is desired, while providing fluid cushioning to dissipate impact forces between the boom 14 and the frame 20; and a second pressure level configured to substantially prevent the boom from achieving the latched position when inadvertent achievement of the latched position is not desired.

Figure 8:
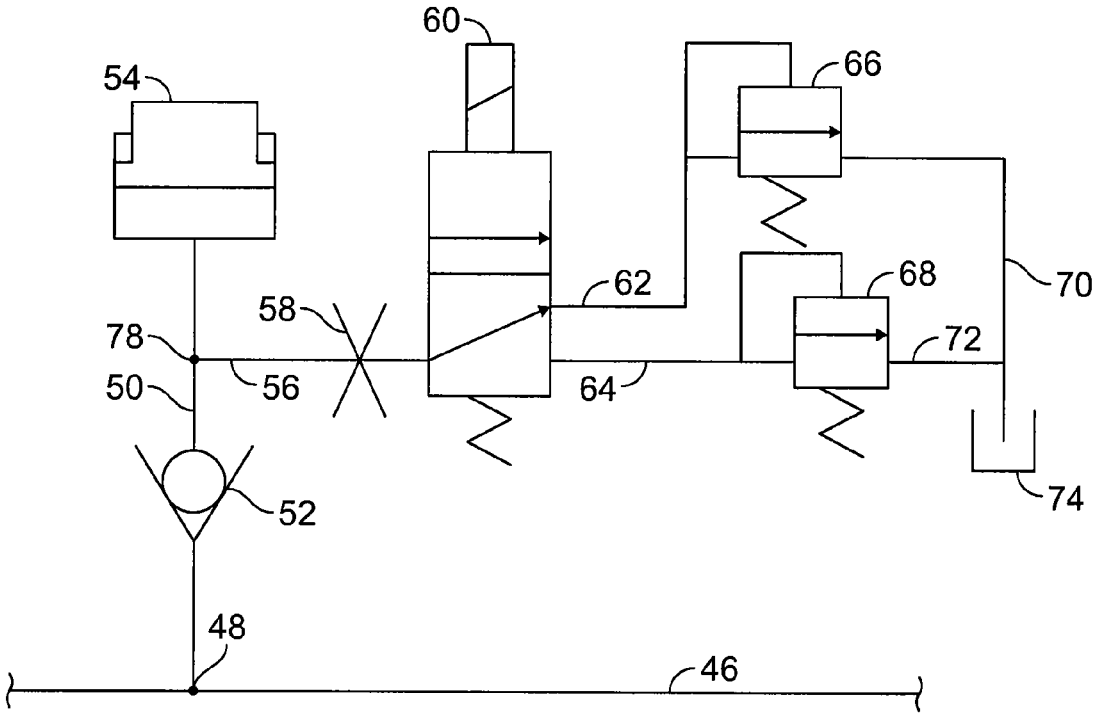
FIGS. 8 and 9 are hydraulic schematics of the fluid circuit of present invention.

FIG. 8 diagrammatically shows fluid ram 54 in a substantially closed fluid circuit. As shown, line 46, such as a relatively low pressure return line maintained between 50-100 psi, maintains fluid in the otherwise closed fluid circuit. That is, to maintain fluid in the circuit, fluid flowing through line 46 flows past junction 48 in fluid communication with line 46 and through line 50 and through one-way valve 52. Fluid ram 54 is in fluid communication with a junction 78 that is in mutual fluid communication with a line 56. As shown in FIG. 8, a restriction 58 is formed in line 56 prior to line 56 fluidly connecting to a valve 60, such as a solenoid valve. It is to be understood that valve 60 can be of other valve construction, such as a manually operated or hydraulic servo valve, or any other construction permitting the machine operator to selectively control the position(s) of the valve. In a first position of valve 60, as shown in FIG. 8, opposite restriction 58, valve 60 is in fluid communication with a line 62 that is connected to a valve 66, such as a relief valve, with a line 70 opposite valve 66 to permit fluid flowing through the valve 66 to reach a reservoir 74. Valve 66 is configured to prevent the flow of fluid therethrough, the pressure setting set significantly higher than the normal pressures flowing through line 62, such as 1,000 psi, the value normally set below a level that would damage components in the event of malfunction of the machine. In response to the high pressure setting of valve 66, valve 66 normally will not open, so that the fluid contained in lines 50, 56 and 62 will not flow.

The configuration of FIG. 8 corresponds to an operating condition in which the operator does not wish for the boom 14 to inadvertently latch with frame 20 as previously discussed. That is, upon boom 14 being raised to a substantially raised position, fluid ram 54 will generate sufficient reactive forces upon being compressed between frame 20 and boom 14 to substantially prevent the boom from achieving the latched position. In addition to substantially preventing the latched position, impact between frame 20 and boom 14 is avoided, and since impact avoidance occurs by virtue of pressurized fluid, there is significant damping of the forces, likewise significantly removing shock loading, i.e., significantly smoothing the operations of the boom.

Figure 9:
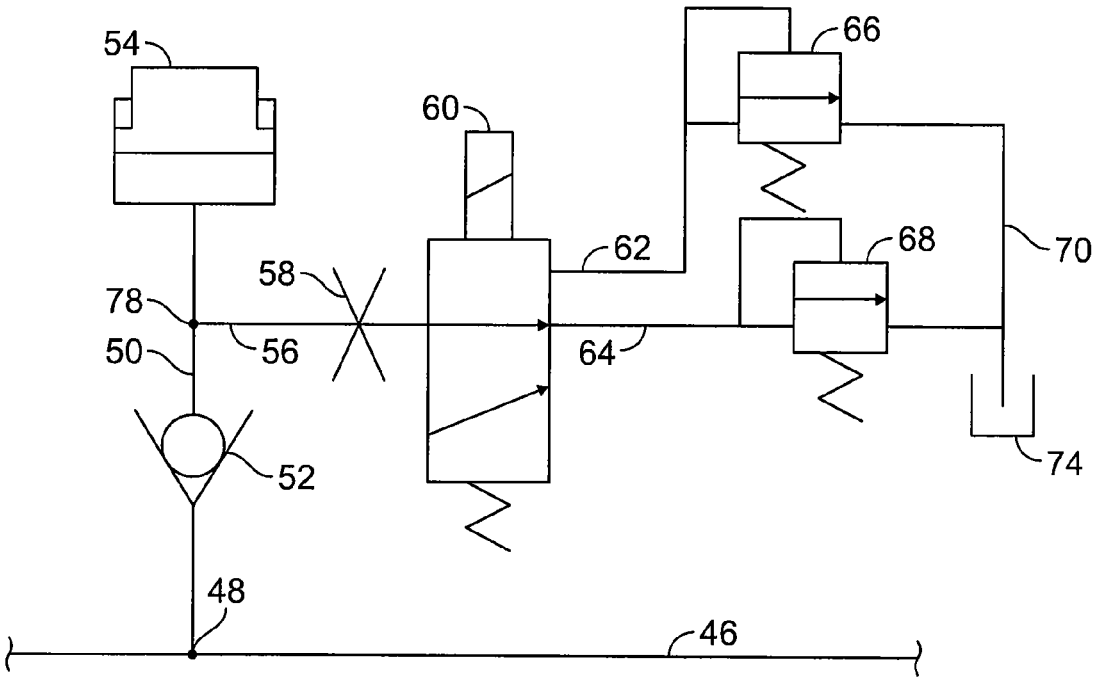

In a second position of valve 60, as shown in FIG. 9, opposite restriction 58, valve 60 is in fluid communication with a line 64 that is connected to a valve 68, such as a relief valve, with lines 70,72 opposite valve 68 to permit fluid flowing through the valve 68 to reach reservoir 74. It is to be understood that valve 68 can be of other valve construction, such as a manually operated or hydraulic servo valve, or any of construction permitting the machine operator to selectively control the position(s) of the valve. Although valve 68 is configured not to permit the flow of fluid therethrough, the pressure setting is to be set within or at least not significantly greater than the normal operating pressures of the line 46, such as 75 psi, the value not normally to be set below a level that would damage components in the event of malfunction of the machine. In response to the relatively low pressure setting of valve 68, valve 68 will open in response to sufficient compressive forces applied by boom 14 and frame 20, so that the fluid contained in lines 50, 56 and 64 will flow through valve 68, then through lines 68, 70 to reservoir 74. However, due to restriction 58 formed in line 56, the rate of fluid flow is reduced, so that fluid ram 54 is compressed more slowly in response to the compressive forces. In other words, the rate of compression of fluid ram 54 is sufficiently slowed to significantly dampen the compressive forces and thereby reduce impact forces that would otherwise occur between boom 14 and frame 20.

The configuration of FIG. 9 corresponds to an operating condition in which the operator wishes for the boom 14 to latch with frame 20 as previously discussed. That is, upon boom 14 being raised to a substantially raised position, fluid ram 54 will not generate sufficient pressure upon being compressed between frame 20 and boom 14 to substantially prevent the boom from achieving the latched position. However, the combination of the reduced pressure in addition to the restricted fluid flow from fluid ram 54, such as through restrictor 58, will permit significant dissipation of forces that would otherwise result in significant impact between boom 14 and frame 20, reducing shock loads and reducing the amount of premature wear of machine components, as well as providing a more comfortable environment for the machine operator.

Additionally, the configuration of FIG. 8 may also be employed to reduce the amount of shock loading, in the form of "chatter", generated by subsequent transport of the machine with the boom 14 in the latched position. That is, once the latched position between boom 14 and frame 20 is achieved, fluid ram 54 remains in its extended position, due to there being substantially no fluid flowing through valve 66, thereby continuing to apply a tensile force to the latching device 76 to maintain contact between the boom 14 and the frame 20. Stated another way, fluid ram 54 substantially prevents movement of the boom 14 relative to the frame 20 in the latched position. If desired, a third valve, in addition to valves 66, 68 could be added, to more beneficially achieve this result. That is, the third valve could be configured to permit fluid flow at a pressure level less than valve 66, but at a pressure level greater than valve 68, or a pressure level greater than valve 66.

In addition, it is to be understood that components other than those identified in the embodiments of FIGS. 8 and 9 could be substituted, such as hydraulic servo valves or manual valves in place of a solenoid valve. That is, it is to be understood that other embodiments can be constructed to provide damping or prevent the impact between the boom and frame as discussed above.

It is to be understood that in addition to the embodiments specifically discussed, i.e., backhoe booms with an over-center fluid ram arrangement, other arrangements are also contemplated. For example, the damping system of the present invention can be used with backhoes without an over-center fluid ram arrangement. In addition, the damping system could also be used with any excavating machine using a boom that pivots on a frame about a horizontal axis between raised and lowered positions by a fluid ram as previously described.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for use with a boom, the boom pivoted on a frame about a horizontal pivot axis between raised and lowered positions by a first fluid ram joining the frame and the boom; a releasable locking mechanism for locking the boom relative to the frame to prevent pivotal movement of the boom about its horizontal pivot axis, the system comprising:

a second fluid ram disposable between the frame and the boom, the second fluid ram compressible between the frame and the boom when the boom is adjacent the raised position, but prior to the boom achieving a latched position substantially coinciding with the raised position;

wherein a fluid circuit of the second fluid ram having two selectable pressure levels, the first pressure level substantially preventing the boom from achieving the latched position, the second pressure level permitting the boom to achieve the latched position while providing fluid cushioning to dissipate impact forces between the boom and the frame.

2. The system of claim 1, wherein a restriction is disposed in the fluid circuit to slow the flow of fluid from the second fluid ram.

3. The system of claim 1, wherein fluid is provided to the fluid circuit by a return fluid line of a second fluid circuit in fluid communication with the fluid circuit.

4. The system of claim 1, wherein the boom is a backhoe boom.

5. The system of claim 1, wherein the second fluid ram includes a resilient material secured thereto.

6. The system of claim 1, wherein the second pressure level is sufficient to substantially prevent pivotal movement of the boom in the latched position.

7. The system of claim 1, wherein the fluid circuit includes a solenoid valve.

8. The system of claim 1, wherein the fluid circuit includes a hydraulic servo valve.

9. The system of claim 1, wherein the fluid circuit includes a manual valve.

10. An excavating machine comprising:

a backhoe boom, the boom pivoted on a frame about a horizontal pivot axis between raised and lowered positions by a first fluid ram joining the frame and the boom;

a releasable locking mechanism for locking the boom relative to the frame to prevent pivotal movement of the boom about its horizontal pivot axis;

a second fluid ram disposed between the frame and the boom, the second fluid ram compressed between the frame and the boom when the boom is adjacent the raised position, but prior to the boom achieving a latched position substantially coinciding with the raised position; and wherein a fluid circuit of the second fluid ram having two selectable pressure levels, the first pressure level substantially preventing the boom from achieving a latched position, the second pressure level permitting the boom to achieve a latched position while providing fluid cushioning to dissipate impact forces between the boom and the frame.

11. The machine of claim 10, wherein a restriction is disposed in the fluid circuit to slow the flow of fluid from the second fluid ram.

12. The machine of claim 10, wherein fluid is provided to the fluid circuit by a return fluid line of a second fluid circuit in fluid communication with the fluid circuit.

13. The machine of claim 10, wherein the boom is a backhoe boom.

14. The machine of claim 10, wherein the second fluid ram includes a resilient material secured thereto.

15. The machine of claim 10, wherein the second pressure level is sufficient to substantially prevent pivotal movement of the boom in the latched position.

16. The machine of claim 10, wherein the fluid circuit includes a solenoid valve.

17. The machine of claim 10, wherein the fluid circuit includes a hydraulic servo valve.

18. The machine of claim 10, wherein the fluid circuit includes a manual valve.

19. A method for dissipating impact forces associated with selectively achieving a latched position of a backhoe boom of an excavating machine, the latched position suitable for transport of the excavating machine, while selectively avoiding inadvertent achievement of the latched position, the method comprising the steps of:

providing the backhoe boom and a frame, the boom pivoted on the frame about a horizontal pivot axis between raised and lowered positions by a first fluid ram joining the frame and the boom; providing a releasable locking mechanism for locking the boom relative to the frame to prevent pivotal movement of the boom about its horizontal pivot axis; a second fluid ram in fluid communication with a fluid circuit having two pressure levels;

selecting a first pressure level configured to permit the boom to achieve the latched position, when achievement of the latched position is desired, while providing fluid cushioning to dissipate impact forces between the boom and the frame; and selecting a second pressure level configured to substantially prevent the boom from achieving the latched position when inadvertent achievement of the latched position is not desired.

20. The method of claim 19, wherein the second pressure level is sufficient to substantially prevent pivotal movement of the boom in the latched position.

* * * * *